US005830059A

United States Patent [19]

Sells

[11] Patent Number: 5,830,059

[45] Date of Patent: Nov. 3, 1998

[54] VENTILATING CAP FOR THE RIDGE OF A ROOF

[75] Inventor: Gary L. Sells, Mishawaka, Ind.

[73] Assignee: Cor-A-Vent Inc., Mishawaka, Ind.

[21] Appl. No.: 880,495

[22] Filed: Jun. 23, 1997

[51] Int. Cl.[6] ..... F24F 7/02

[52] U.S. Cl. ..... 454/365; 52/199

[58] Field of Search ..... 52/199; 454/364, 454/365, 366, 367

[56] References Cited

U.S. PATENT DOCUMENTS

| | | | |
|---|---|---|---|
| 4,325,290 | 4/1982 | Wolfert | 454/365 |
| 4,924,761 | 5/1990 | MacLeod et al. | 454/365 |
| 5,092,225 | 3/1992 | Sells | 454/365 |
| 5,328,407 | 7/1994 | Sells | 454/365 |
| 5,603,657 | 2/1997 | Sells | 454/365 X |
| 5,673,521 | 10/1997 | Coulton et al. | 454/365 X |

*Primary Examiner*—Harold Joyce
*Attorney, Agent, or Firm*—Baker & Daniels

[57] ABSTRACT

A ventilating cap for the roof includes a cover which is supported over a vent opening extending along the ridge of the roof by a first pair of coil springs supporting one side of the cap and a second pair of coil springs supporting the other side of the cap. Optional foam rubber blocks may be installed between the pairs of coils and also extend longitudinally along the roof to restrict entry of wind blown moisture from entering the vent opening. In another embodiment of the invention, nonwoven batts are retained by the springs to restrain entry of moisture into the vent opening. In still another embodiment of the invention, a deflectable baffle is moved from an inactive position laying on the roof to an active position closing off passages between the coils to wind blown moisture in response to wind velocity above a predetermined level.

23 Claims, 13 Drawing Sheets

VENTILATING CAP FOR THE RIDGE OF A ROOF

This invention relates to roof ridge vents for ventilating the attic or upper story of building structures.

It is desirable that the attic or upper story of building structures be vented to atmosphere to prevent heat build up within the structure. Roof ridge vents have become increasingly popular in providing this needed ventilation. Roof ridge vents extend along the ridge of a pitched roof, and cover a ventilating opening that is cut longitudinally in the roof, usually extending parallel to, and on both sides of, the roof ridge board. A ventilating cap is installed on the roof and extends over the ventilating opening. The ventilating cap includes vent parts attached to the roof adjacent and on both sides of the ventilating opening, which have ventilating passages extending therethrough to venting. Such vent caps are disclosed in U.S. Pat. Nos. 3,949,657 and 5,092,225.

The present invention relates to a roof ridge vent in which a ventilating cap consists of a cover extending over the vent opening and which is supported on the roof by longitudinally extending coil springs. These springs are stretched so that the distance between the coils of the springs provide the desired passages through which venting takes place. Porous material, such as a block of foam rubber, may be provided to extend longitudinally adjacent the coiled springs to restrict entry of wind driven moisture into the ventilating opening. According to another embodiment of the nonwoven batts may either be installed within the coils of the spring or may be retained by the springs and extend over the ventilation opening, also to prevent entry of wind driven moisture into the ventilation opening. According to still another embodiment of the invention, a baffle normally resting in an inactive position against the surface of the roof responds to wind in excess of a predetermined velocity to move upwardly covering one side of the spring, thereby preventing wind driven moisture from entering the building, but while in the inactive position preventing free venting of the structure.

Figure 1:
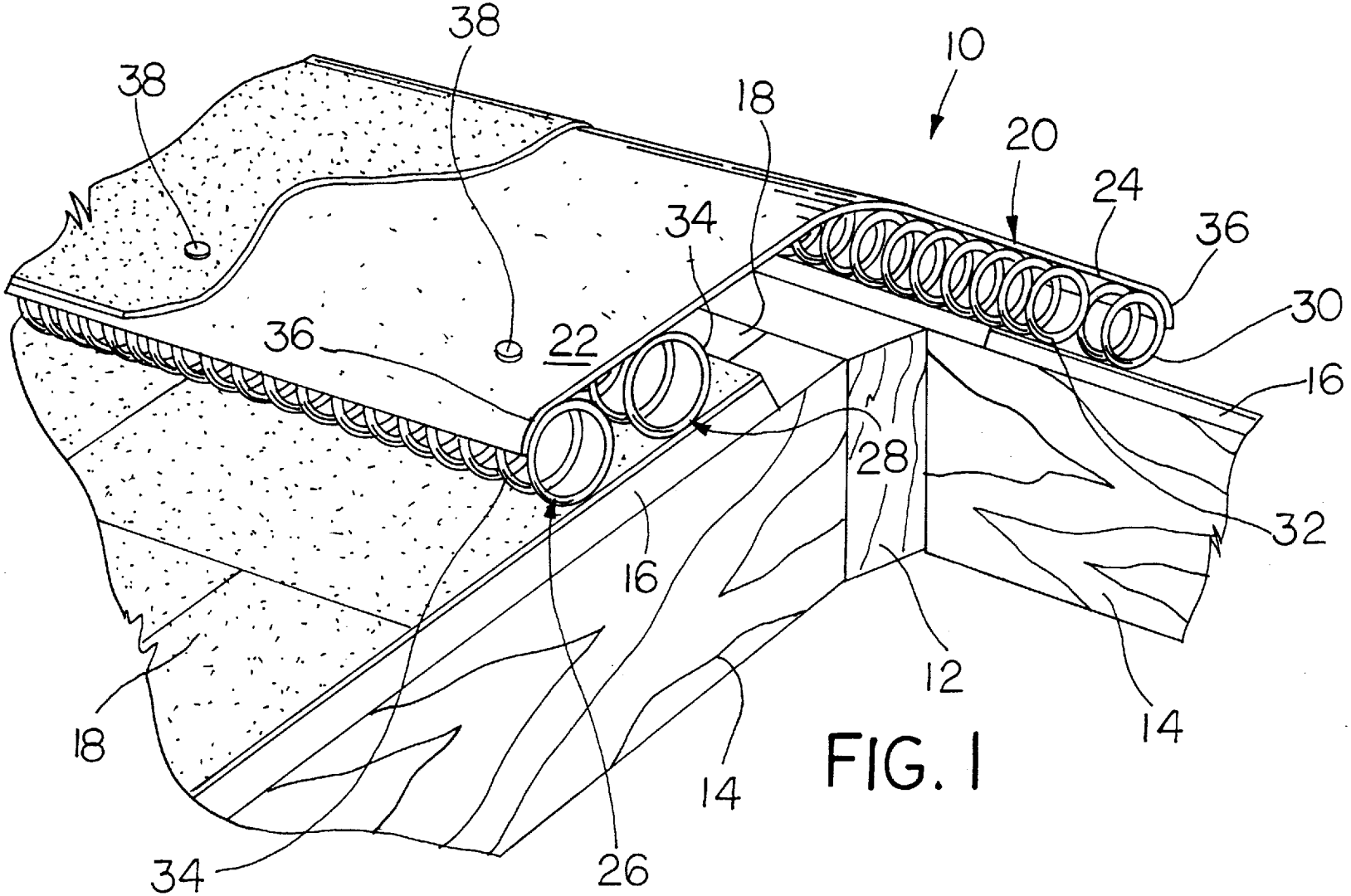
Figure 1A:
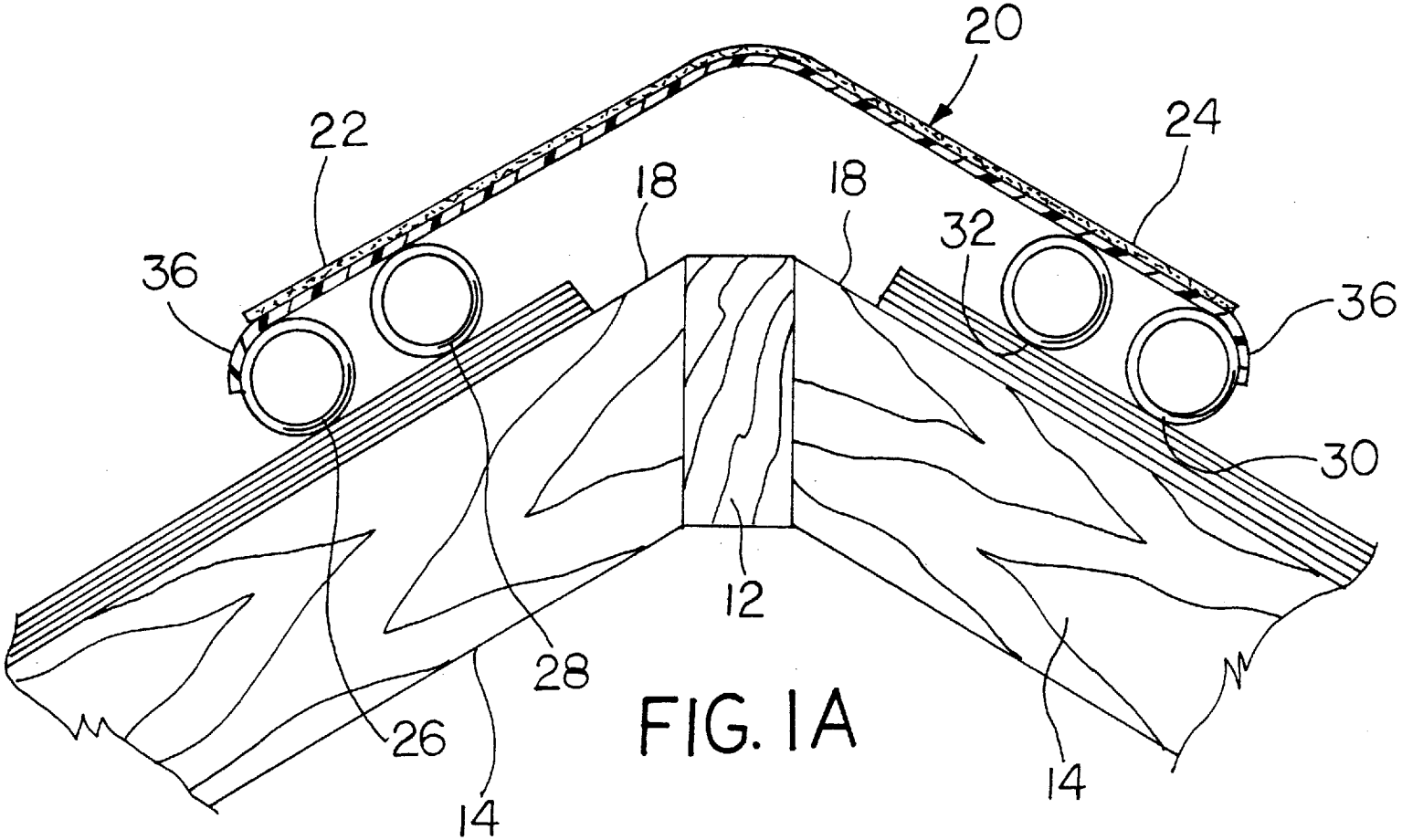
Figure 2:
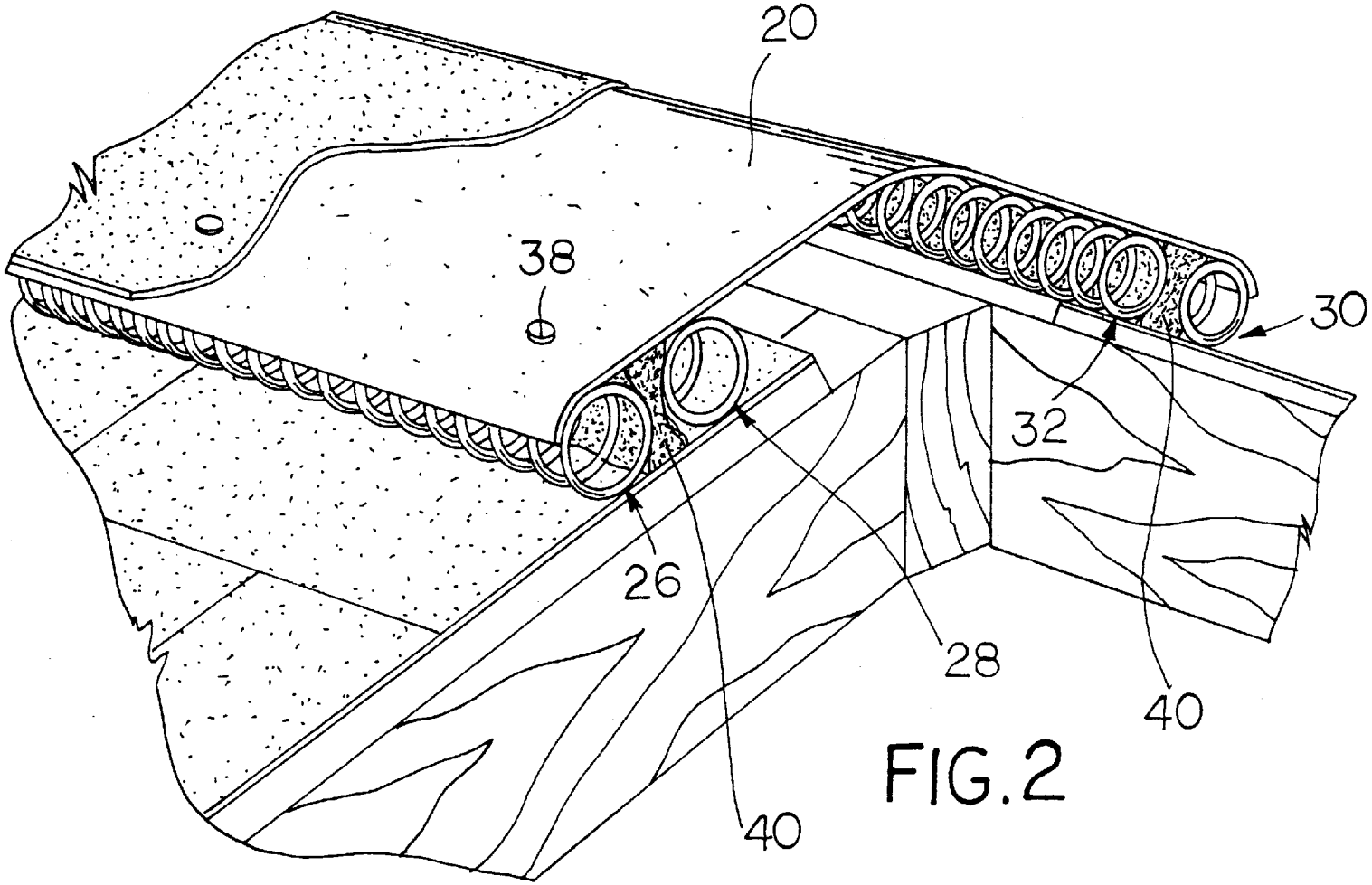
Figure 2A:
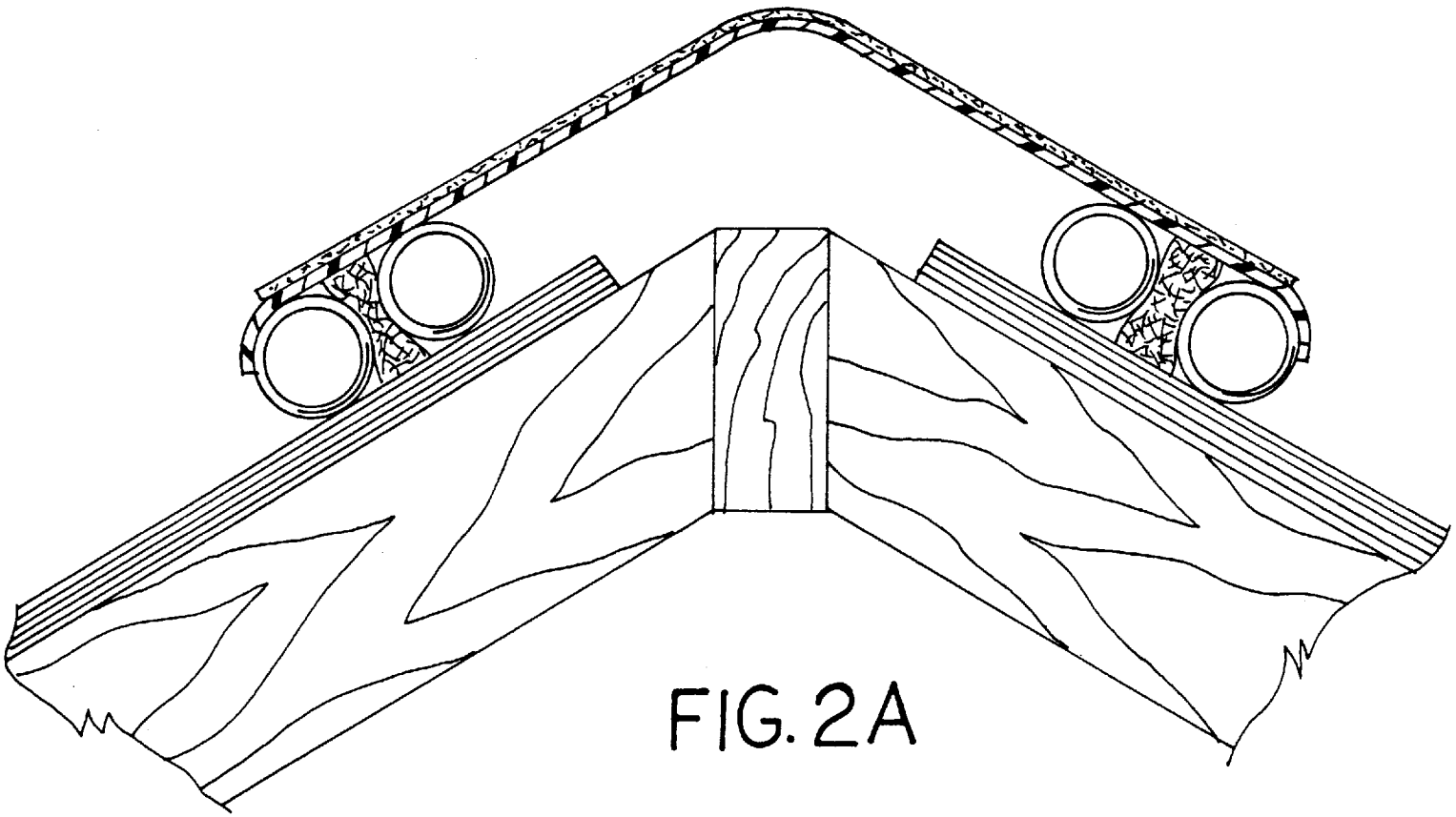
Figure 5:
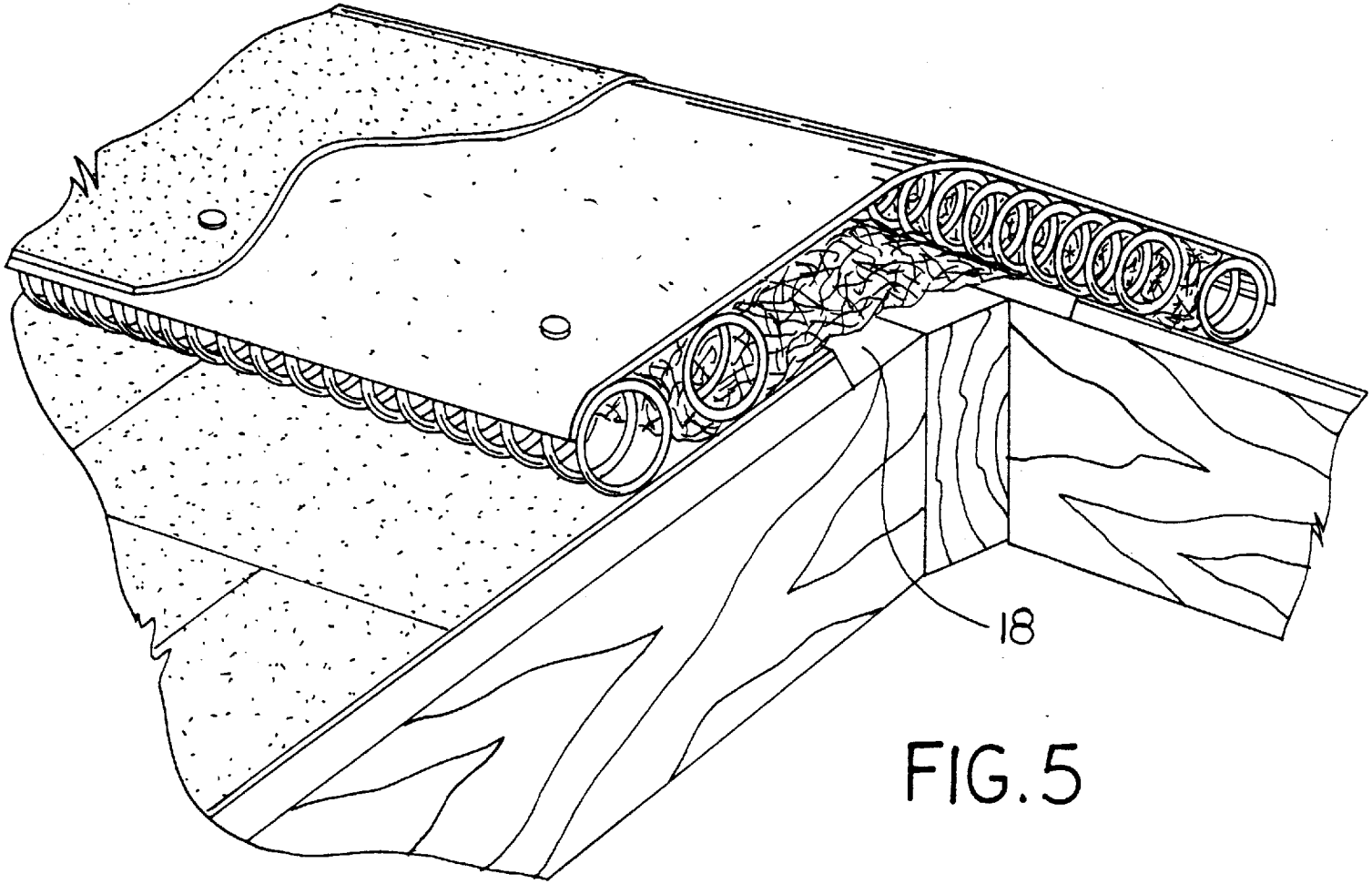
Figure 5A:
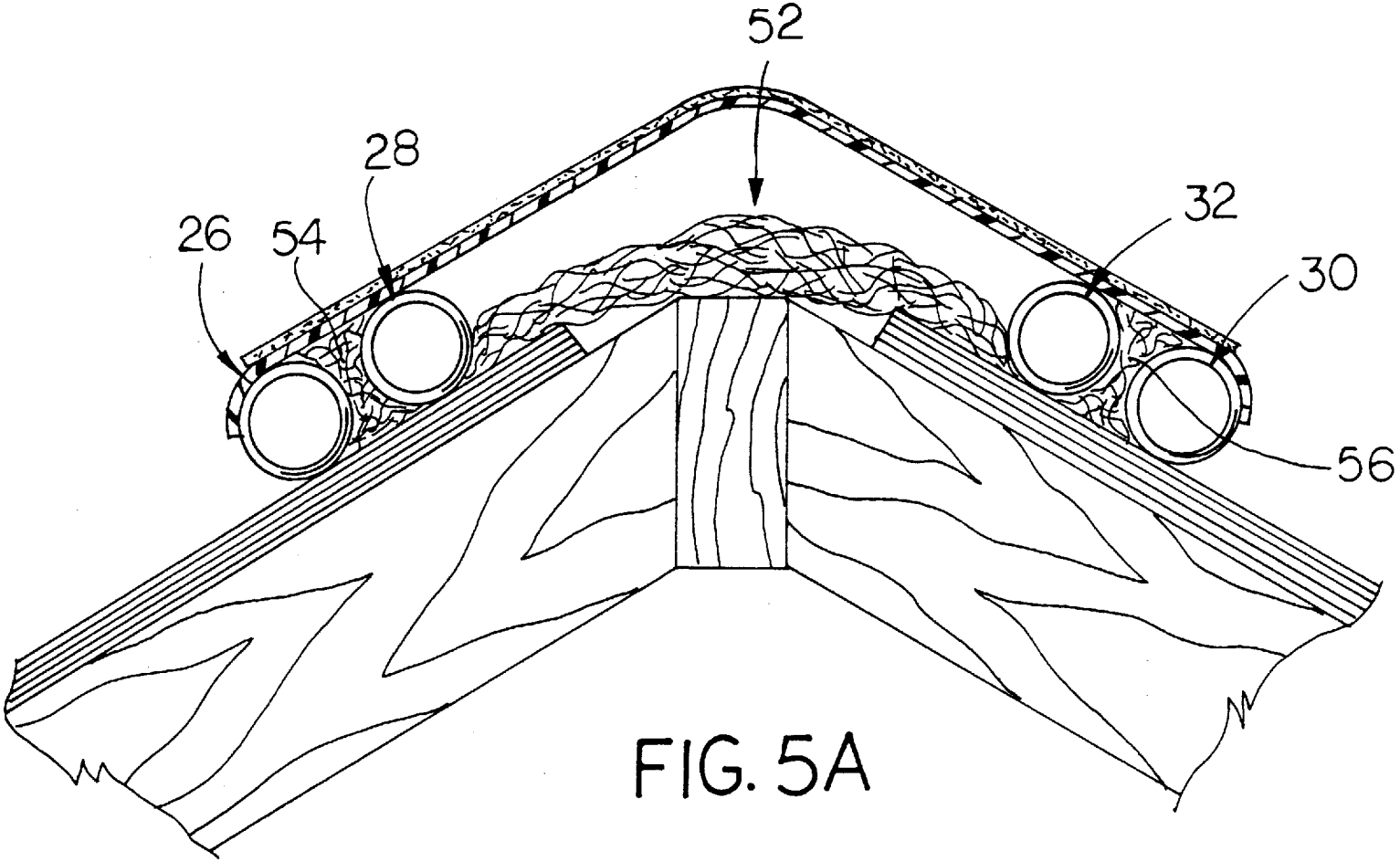
Figure 6:
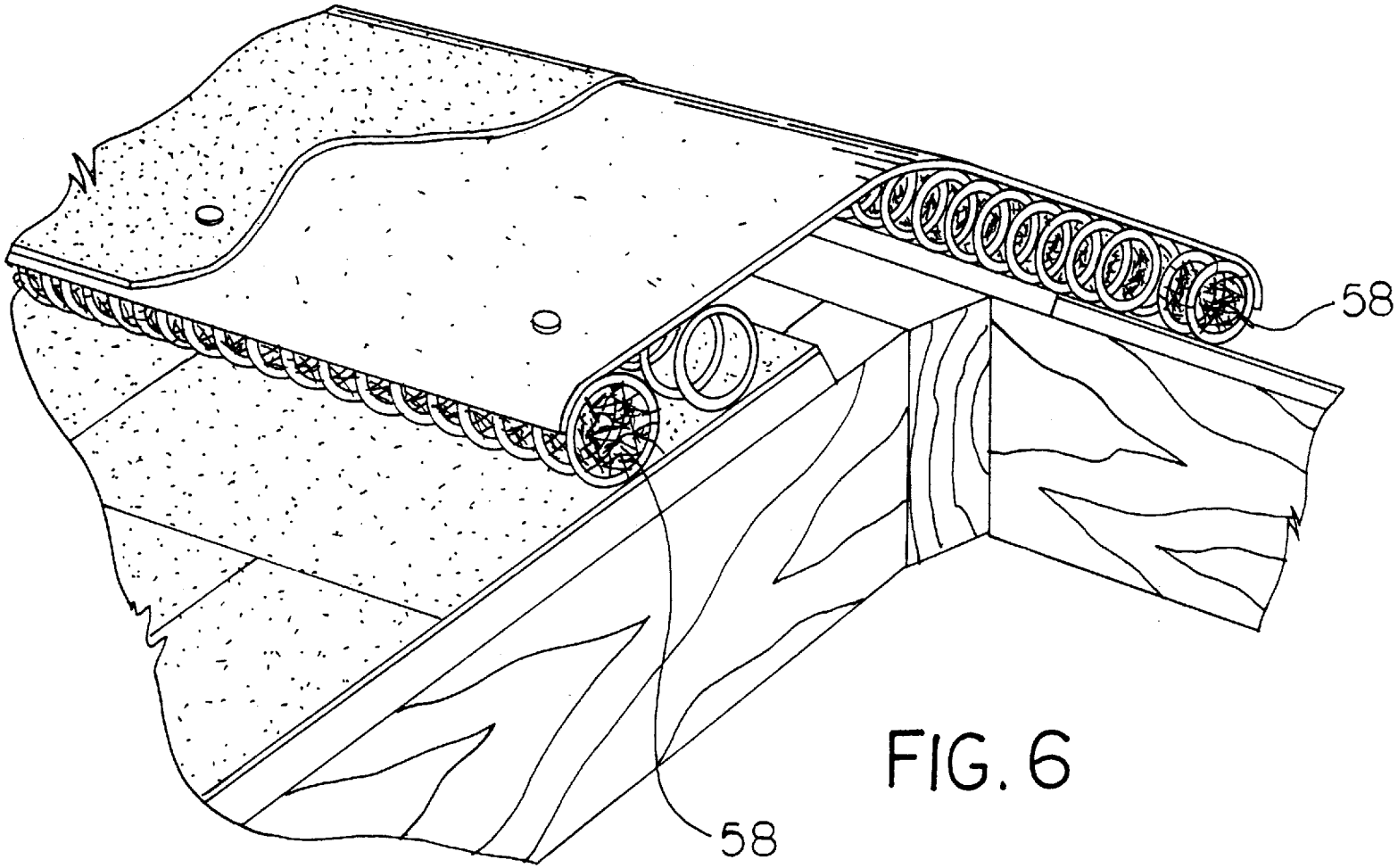
Figure 6A:
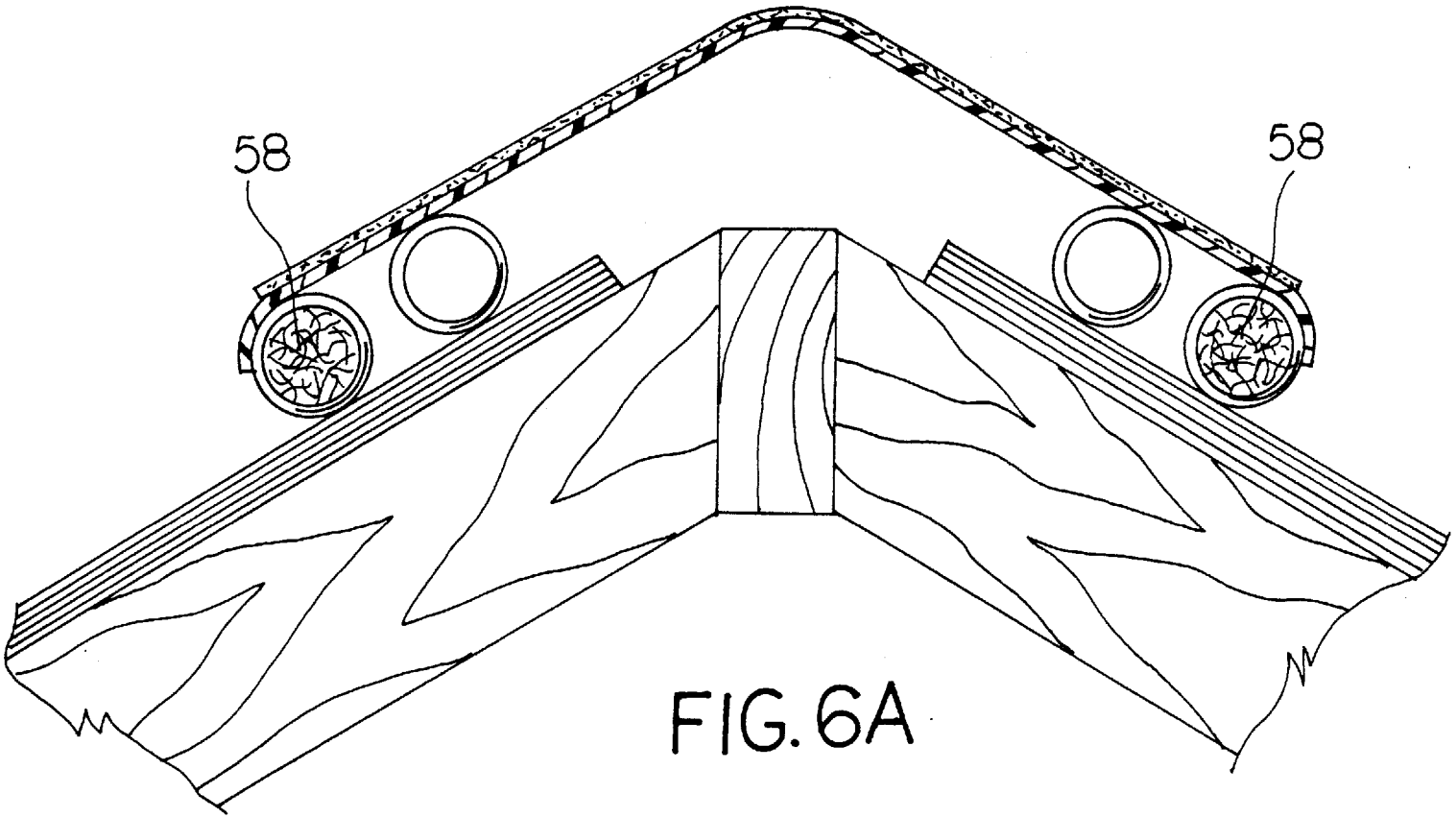
Figure 7:
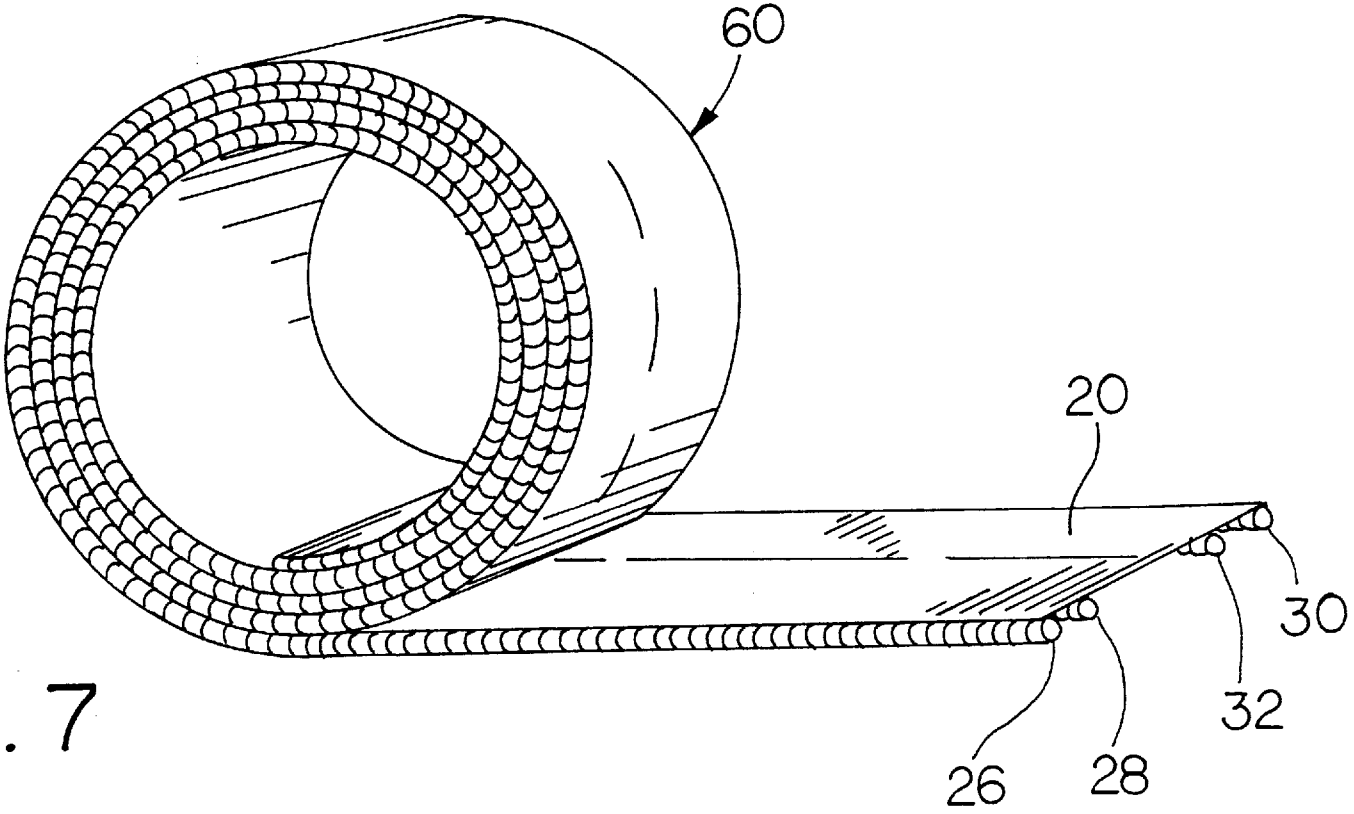

These and other advantages of the present invention will become apparent from the following description, reference being made to the accompanying drawings, in which FIG. 1 is a fragmentary view in perspective of a roof ridge vent made pursuant to the teachings of the present invention shown in use on a roof with portions thereof cut away for ease of illustration;

FIG. 1*a* is a transverse cross-sectional view of the roof and ridge vent illustrated in FIG. 1;

FIGS. 2, 3, 4, 5, and 6, and FIGS. 2*a*, 3*a*, 4*a*, 5*a*, and 6*a*, are views similar to FIGS. 1 and 1*a* respectively, and illustrating alternating embodiments of the invention; and FIG. 7 is a view and perspective of the vent cap material rolled up into an interior roll for transportation and storage.

Referring now to the drawings numeral 10 refers generally to the roof vent of the present invention. The vent 10 is applied to a conventional pitched roof which includes a ridge board 12 which extends longitudinally along the ridge of the roof and which is supported by transversely spaced inclined rafters 14, as is well known to those skilled in the art. Conventional underlayment 16 is nailed to rafters 14, and conventional shingles 19 are nailed to the underlayment 16 to complete the roof.

According to the invention, longitudinally extending vent openings 18 are cut and the underlayment 16 adjacent the ridge board 12 and extend parallel to the ridge boards 12. Accordingly, air trapped in the attic or upper story of the structure may be vented through vent openings 18.

A cap or cover generally indicated by the numeral 20 bridges across the vent openings 18 and the ridge board 12 and includes side portions 22, 24. Portion 22 is supported off of the roof by a first pair of spiral wound springs 26, 28, and the portion 24 is supported up off of the roof a second pair of spiral wound springs 30, 32. Each of the springs 26–32 consists of coils 34. The springs 26–32 extend substantially parallel to one another and also parallel to the vent openings 18. The springs are attached to the cover 20 by applying a longitudinal bead of adhesive along the side of the cover facing the roof and then imbedding the coils 34 in the adhesive. The springs 26–32 are first stretched along the cover 20 so that the desired distance between the coils 34 is achieved. Accordingly, the coils 34 cooperate with one another to define passages therebetween, so that relatively unrestricted venting is permitted through the vent opening 18 and the passages defined between the coils 34. The side portions 22, 24 terminate in turned over portions 36 which are curved to conform to the radius of the coils 34, and are engaged therewith. Accordingly, the coils 34 and the turned over portions 36 tend to deflect moisture away from the vent opening 18. The cap is secured to the roof by appropriate nails 38 (or other similar fasteners) which extend through the cover 20, shingles 19 which are placed on the cover, and between the coils of a corresponding one of the springs 28–32.

Figure 3:
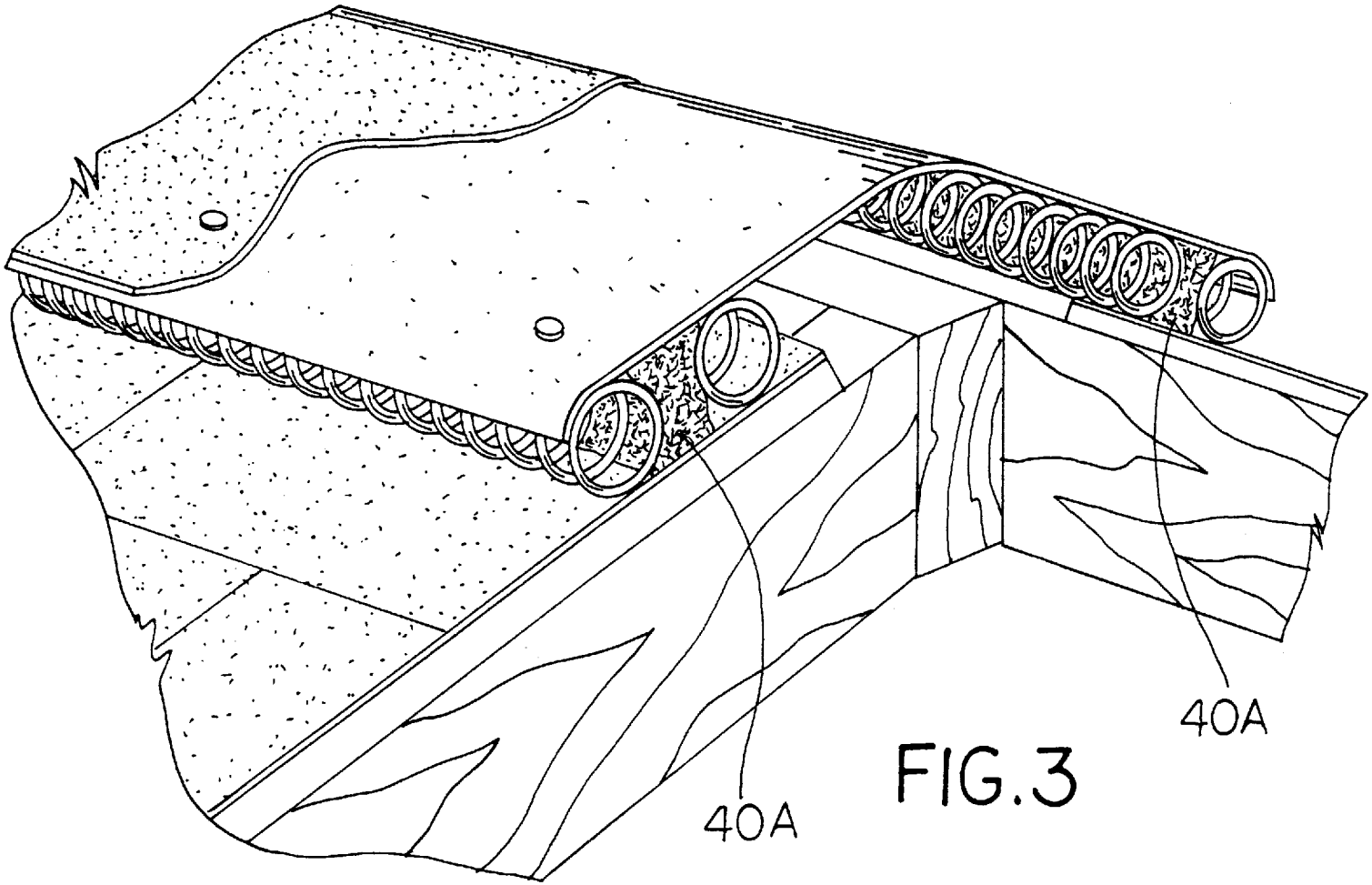
Figure 3A:
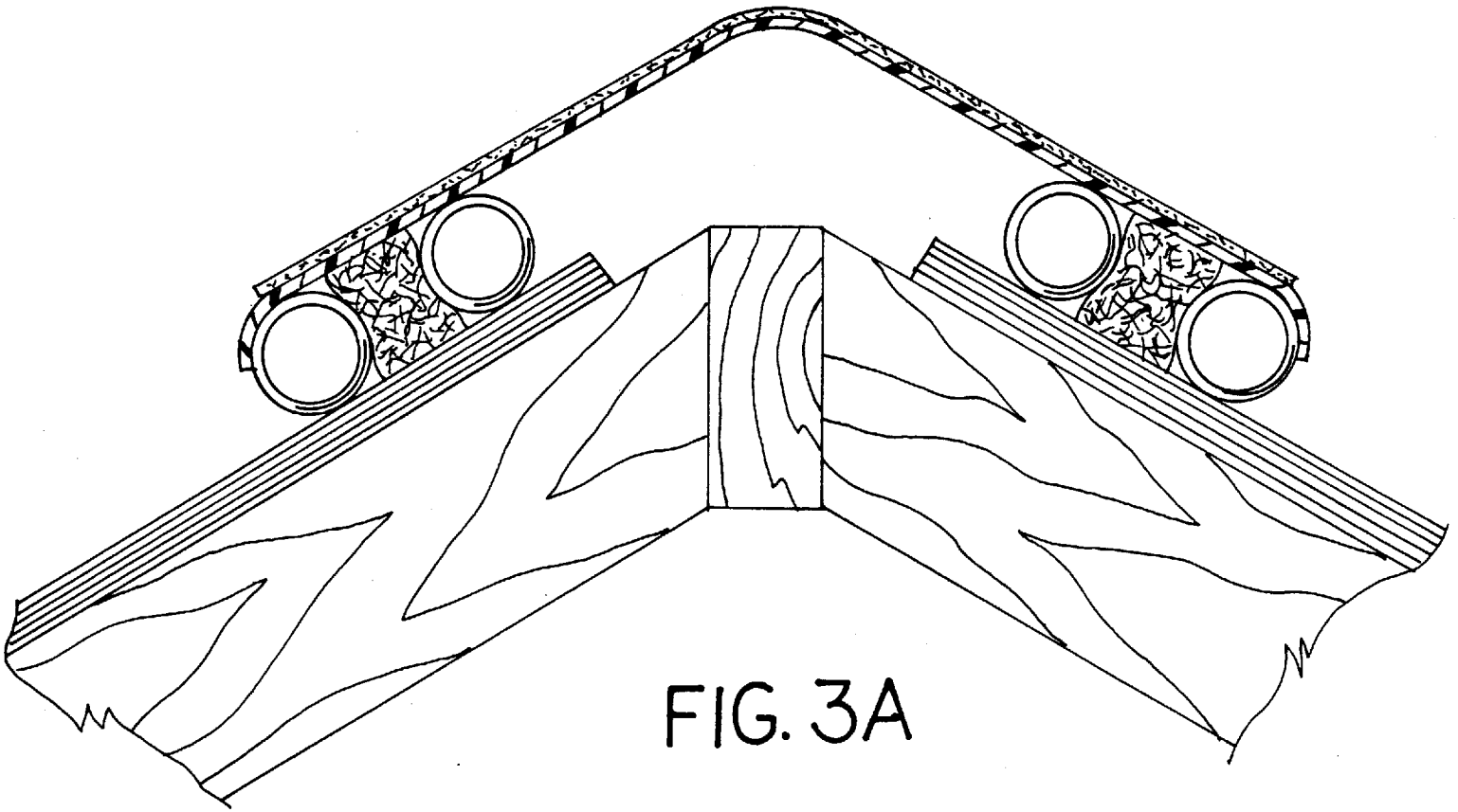

The protection provided by the turned over portions 36 and by the coils 34 may under certain circumstances be insufficient to prevent moisture from entering the vent openings 18. Accordingly, and referring to FIGS. 2, 2*a*, and 3, 3*a*, longitudinally extending blocks 40 of foam rubber may be installed between the coiled springs 26–28 and between the coil springs 30, 32. As can be seen in FIGS. 3 and 3*a*, a wide block 40 may be used or, in the case of FIGS. 2 and 2*a*, narrow blocks of foamed rubber material maybe used. The width of the block is chosen such that the venting is restricted by a minimal amount, yet wind driven moisture is effectively stopped from entering the vent openings. Either open cell or closed cell materials may be used, but open celled is preferred since air will readily pass through open cell material that will less readily pass through closed cell material; accordingly, the closed cell material will be more restrictive of venting than will the open cell material. Open cell material will, however, retain moisture, while the closed cell material will repel and deflect moisture. Whether moisture is absorbed or repelled by the material, in either case wind driven moisture is restrained from reaching the vent openings 18.

Figure 4:
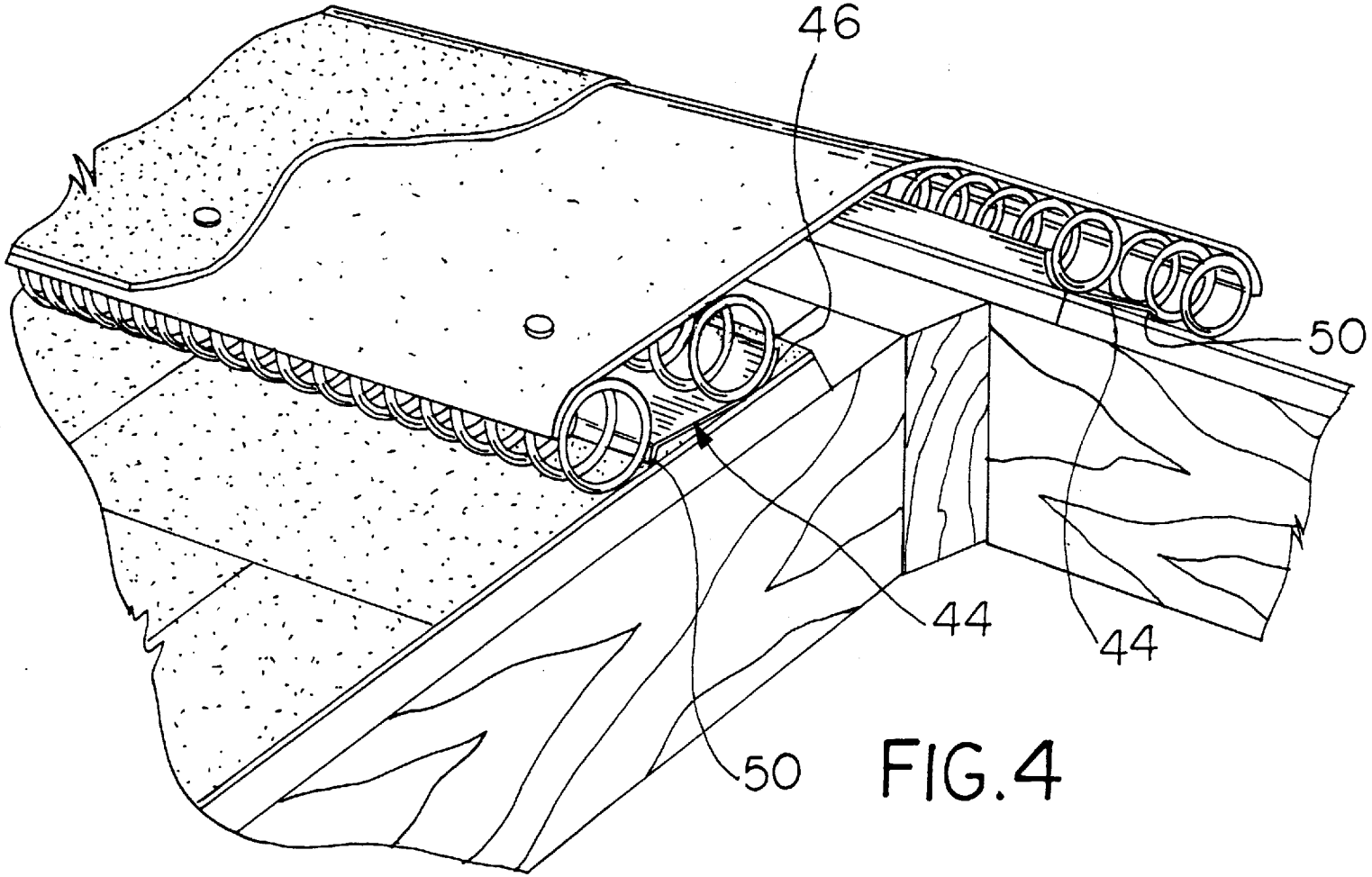
Figure 4A:
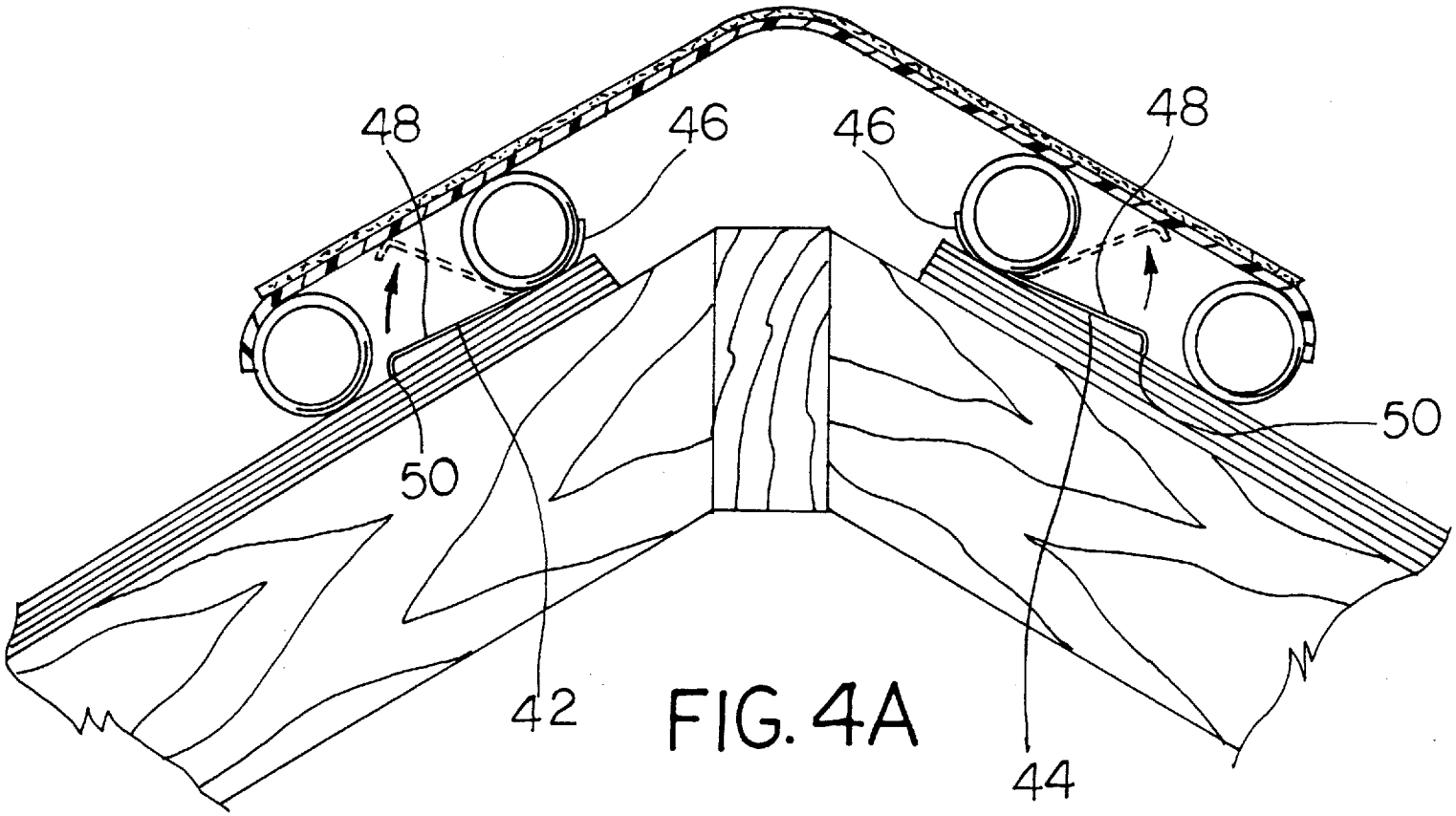

Referring now to FIGS. 4 and 4*a*, a longitudinally extending, air impermeable baffle 42 is installed between the springs 26, 28 and an identical baffle 44 is installed between the springs 30, 32. Each of the baffles 42, 44 include an arcuate retaining portion 46 that extends longitundinally along one side of the baffle and that is received below corresponding spring 28 or 32, to thereby secure the baffles 42, 44 in place. Each of the baffles 42, 44 further include an active portion 48 that extends from the retaining portion 46 toward the other spring 26 or 30. Each of the active portions 48 terminate in an outwardly extending lip 50. The lip 50 prevents the active portion 48 from laying flat against the roof and thus acts as a "scoop" when wind exceeds a predetermined velocity. Accordingly, when a predetermined wind velocity is exceeded, the wind acts against the active portion of the baffles 42, 44, lifting them from the inactive positions indicated by the solid lines in FIGS. 4*a* to the active positions indicated in the dashed lines in FIGS. 4*a*. In the active positions indicated by the dashed lines, the scoops 50 are engaged with the cover 20, thereby acting as a barrier to wind blown moisture, so that the vent openings 18 are protected from wind blown moisture when wind velocity exceeds a predetermined level.

Referring now to FIGS. 5 and 5*a*, the vent openings 18 are protected from wind driven moisture by a nonwoven batt indicated by the numeral 52. Batt 52 includes edge portions 54, 56. Portion 54 is clamped between the springs 26, 28, and edge portion 56 is clamped between springs 30, 32. It will be noted that the pair of springs 26, 28 and the pair of springs 30, 32 are sufficiently close together that they are able to retain their corresponding end portion 54, 56 between them, such that the batt 52 is retained with the cover and spring before it is installed on the roof. The batt 52 extends under the springs 28 and 32 and across the vent openings 18. The batt 52 may include moisture repelling fibers such that moisture will be restricted from entering the vent openings 18.

Referring now to the embodiment of FIG. 6 and 6*a*, a batt material generally indicated by the numeral 58, which is similar to the material from which the batt 52 is formed, is installed within the coils 34 of the springs 26 and 30. The batt material 58 assists the coils 34 of the spring and the turned over portions 36 in deflecting and repelling wind driven moisture from entering the passages defined between the coils 34, thereby restricting entry of moisture into the vent openings 18. The material 58 may include moisture repelling fibers. The batt material 58 as well a the batt 52, can be made by any well known process for forming nonwoven batts.

Referring now to FIG. 7, it is desirable to manufacture cover 20 of a semi-rigid material such that the cover 20 may be formed in the necessary shape as illustrated in FIGS. 1–6, yet is sufficiently flexible that it can be rolled in a roll such as the roll 60. The springs 26–32, since they are spiral wound springs can be coiled into a roll as shown. Ideally, the material from which the cover 20 is made is sufficiently ridged that the cover may be formed in the necessary shape, and sufficiently resilient that once the roll 60 is unrolled on the ridge of a roof, the cover 20 automatically resumes the shape illustrated in FIGS. 1–6. By being able to roll the material in a roll, shipping, handling and warehousing costs are minimized, yet the material can be made in virtually any length such that it may be unrolled on the ridge of a roof when the material is installed and then cut to the necessary length.

What is claimed:

1. A ventilating device for a roof of a structure having a longitudinally extending ridge board and a vent opening in said roof extending longitudinally along said ridge board, said ventilating device including a cover extending over said ridge board and longitudinally along the vent opening, and coiled members extending longitudinally along said cover and on opposite sides of said vent opening to support said cover over said vent opening, said coiled members being defined by spaced coils defining passages therebetween to permit venting of said structure through said vent opening and the passages defined by said coils.

2. Ventilating device as defined in claim 1, wherein said coiled members are spirally wound springs, said springs being stretched along said cover to provide a predetermined spacing between said coils to define said passages.

3. Ventilating device as claimed in claim 1, wherein a fastener extends through said cover and between the coils of the coiled member to secure the ventilating device to the roof.

4. Ventilating device as claimed in claim 1, wherein said cover is sufficiently flexible that the cover with the coiled members secured thereto may be rolled into a roll for transportation and storage.

5. Ventilating device as claimed in claim 1, wherein said coiled members include a first pair of coiled members extending substantially parallel to one another and to said vent opening on one side of the vent opening and a second pair of coiled members extending substantially parallel to one another and to said vent opening on the other side of said vent opening.

6. Ventilating device as claimed in claim 5, wherein said coiled members are spirally wound springs, said springs being stretched along said cover to provide a predetermined spacing between said coils to define said passages.

7. Ventilating device as claimed in claim 5, wherein a fastener extends through said cover and between the coils of one of each pair of said coiled members to secure the ventilating device to the roof.

8. Ventilating device as claimed in claim 5, wherein a longitudinally extending air permeable member is installed between the coiled members of at least one of said pair of coiled members.

9. Ventilating device as claimed in claim 8, wherein said air permeable member is a block of foam rubber extending longitudinally between the coiled members of said one pair and substantially parallel to said vent opening.

10. Ventilating device as claimed in claim 5, wherein an air permeable material is installed within the coils of at least one of said coiled members.

11. Ventilating device as claimed in claim 10, wherein said air permeable material is a nonwoven batt including moisture repelling fibers.

12. Ventilating device as claimed in claim 5, wherein an air permeable, nonwoven batt extends from said first pair of coiled members over said vent opening to said second pair of coiled members.

13. Ventilating device as claimed in claim 12, wherein said batt has edges clamped between the coils of each pair to thereby hold the batt in place.

14. Ventilating device as claimed in claim 1, wherein an air permeable, nonwoven batt extends between said coiled members over said vent opening.

15. Ventilating device as claimed in claim 1, wherein an air impermeable baffle is mounted on at least one of said coiled members and is movable between an inactive position permitting venting through said passages to an active position restricting said passages to restrain entry of moisture into said vent opening.

16. Ventilating device as claimed in claim 15, wherein said baffle includes a retaining portion mounted between said one coiled member and the roof and an active portion extending from said retaining portion, said active portion being normally biased to an inactive position engaged with the roof but responding to wind to move to an active position covering said passages.

17. In a structure having a roof and a longitudinally extending vent opening in said roof, a ventilating device covering said opening including a cover extending over said opening, spiral wound springs defining spaced coils extending along opposite sides of said vent opening to support the cover over the vent opening, said ventilating device allowing venting of said structure to atmosphere via said vent opening and the passages defined between the coils, and fasteners extending through said cover and between the coils of the springs to secure the ventilating device to the roof.

18. Ventilating device as claimed in claim 17, wherein said cover is sufficiently flexible that the cover with the spiral wound springs may be rolled into a roll for transportation and storage.

19. Ventilating device as claimed in claim 17, wherein said springs include a first pair of springs extending substantially parallel to one another and to said vent opening on one side of the vent opening and a second pair of springs extending substantially parallel to the first pair of springs on the other side of said vent opening.

20. Ventilating device as claimed in claim 17, wherein an air permeable porous member is carried by said springs to restrict entry of moisture passing through the passages from entering the vent opening.

21. Ventilating device as claimed in claim 20, wherein said air permeable porous member is foam rubber.

22. Ventilating device as claimed in claim 20, wherein said air permeable porous member is a nonwoven batt.

23. Ventilating device as claimed in claim 17, wherein an air impermeable baffle is mounted on at least one of said springs and is movable between an inactive position permitting venting through said passages to an active position restricting said passages to restrain entry of moisture into said vent opening.

* * * * *